US006991178B2

(12) United States Patent
Nolte et al.

(10) Patent No.: US 6,991,178 B2
(45) Date of Patent: Jan. 31, 2006

(54) CONCENTRIC PAINT ATOMIZER SHAPING AIR RINGS

(75) Inventors: Hans-Jürgen Nolte, Besigheim (DE); Harry Krumma, Bönnigheim (DE); Peter Marquardt, Steinheim (DE)

(73) Assignee: Dürr Systems, Inc., Plymouth, MI (US)

( * ) Notice: Subject to any disclaimer, the term of this patent is extended or adjusted under 35 U.S.C. 154(b) by 144 days.

(21) Appl. No.: 10/713,910

(22) Filed: Jan. 24, 2003

(65) Prior Publication Data

US 2004/0144860 A1 Jul. 29, 2004

(51) Int. Cl.
*B05B 17/04* (2006.01)
*B05B 1/28* (2006.01)

(52) U.S. Cl. ..... 239/7; 239/222.11; 239/224; 239/296; 239/297; 239/300; 239/424

(58) Field of Classification Search ..... 239/112, 239/222.11, 222.13, 223, 224, 290, 296, 298, 239/300, 423, 424, 700, 703, 704, 7, 297
See application file for complete search history.

(56) References Cited

U.S. PATENT DOCUMENTS 2,502,210 A * 3/1950 Demuth ..... 239/300
4,376,135 A 3/1983 Patel et al.
4,521,462 A 6/1985 Smythe
4,555,058 A * 11/1985 Weinstein et al. ..... 239/223
4,572,437 A * 2/1986 Huber et al. ..... 239/296
4,589,597 A 5/1986 Robisch et al.
4,601,921 A * 7/1986 Lee ..... 239/224
4,684,064 A 8/1987 Kwok
4,715,314 A 12/1987 Ramseier et al.
4,798,335 A * 1/1989 Tachi et al. ..... 239/296
4,852,810 A 8/1989 Behr et al.
4,919,333 A 4/1990 Weinstein
4,927,081 A 5/1990 Kwok et al.
4,944,459 A 7/1990 Watanabe et al.
4,955,960 A 9/1990 Behr et al.
5,011,086 A 4/1991 Sonnleitner et al.
5,078,321 A 1/1992 Davis et al.
5,127,125 A 7/1992 Skibowski
5,294,217 A 3/1994 Talacko et al.
5,300,006 A 4/1994 Tanaka et al.
5,397,063 A 3/1995 Weinstein
5,565,241 A * 10/1996 Mathias et al. ..... 239/296
5,622,563 A 4/1997 Howe et al.
5,633,306 A 5/1997 Howe et al.
5,662,278 A 9/1997 Howe et al.
5,683,032 A 11/1997 Braslaw et al.
5,704,977 A 1/1998 Baumann et al.
5,820,036 A * 10/1998 Saito ..... 239/224
5,865,380 A 2/1999 Kazama et al.

(Continued)

FOREIGN PATENT DOCUMENTS

DE 41 05 166 A 1 8/1992

(Continued)

*Primary Examiner*—Steven J. Ganey
(74) *Attorney, Agent, or Firm*—Howard & Howard

(57) ABSTRACT

Two steering air currents that can be controlled independently of one another are directed onto the atomizing cone from the steering air ring of an atomizer for the series coating of workpieces, e.g., car bodies, wherein said steering air currents emerge at different radial distances from the atomizer axis and serve to adjust the width of the spray jet in different regions, such that the spray jet of one and the same atomizer can be optimally adapted to the respective workpiece region to be coated.

13 Claims, 1 Drawing Sheet

U.S. PATENT DOCUMENTS

| | | | | |
|---|---|---|---|---|
| 6,037,010 | A | 3/2000 | Kahmann et al. | |
| 6,050,499 | A * | 4/2000 | Takayama et al. | 239/112 |
| 6,090,450 | A | 7/2000 | Kahmann et al. | |
| 6,508,610 | B2 | 1/2003 | Dietrich | |
| 6,589,348 | B2 | 7/2003 | Ott | |
| 6,745,948 | B1 * | 6/2004 | Hidaka et al. | 239/424 |

FOREIGN PATENT DOCUMENTS

| | | | |
|---|---|---|---|
| DE | 43 42 128 | A1 | 6/1995 |
| DE | 196 10 588 | A 1 | 9/1997 |
| DE | 197 09 988 | A 1 | 10/1998 |
| DE | 197 42 588 | A1 | 4/1999 |
| DE | 198 30 029 | A 1 | 1/2000 |
| DE | 199 09 369 | A 1 | 9/2000 |
| DE | 199 37 425 | A 1 | 3/2001 |
| DE | 100 33 986 | A 1 | 1/2002 |
| DE | 100 63 234 | C 1 | 7/2002 |
| DE | 101 30 173 | A 1 | 1/2003 |
| EP | 0 092 043 | A3 | 10/1983 |
| EP | 0 767 005 | A1 | 4/1997 |
| EP | 0 801 991 | A3 | 8/1998 |
| EP | 0 904 848 | A1 | 3/1999 |
| EP | 0 967 016 | A1 | 12/1999 |
| EP | 1 108 475 | A2 | 6/2001 |
| EP | 1 114 677 | A1 | 7/2001 |
| EP | 1 118 388 | A1 | 7/2001 |
| EP | 0 796 663 | B1 | 8/2001 |
| EP | 1 172 152 | A1 | 1/2002 |
| WO | WO 94/22589 | | 10/1994 |

* cited by examiner

CONCENTRIC PAINT ATOMIZER SHAPING AIR RINGS

FIELD OF THE INVENTION

The invention pertains to a method for controlling the width of the spray jet of an atomizer and to an atomizer, for the series coating of workpieces, which comprises outlet openings for producing a gas current that bounds the atomizing cone.

BACKGROUND OF THE INVENTION

The invention specifically pertains to the control of steering air in electrostatic rotary atomizers as they are conventionally utilized for the series coating of workpieces, e.g., car bodies. However, the invention can also be utilized in other types of atomizers. The invention is suitable for arbitrary coating materials, including coating liquids and coating powders.

In conventional rotary atomizers (DE 4306800), the steering air is directed from the atomizer onto the conical outer surface of the bell, wherein this steering air not only provides the coating particles that are radially expelled at the edge of the bell dish with an additional impetus in the direction of the workpiece, but it also serves to form the spray jet, and in part, to assist in the atomizing process. The steering air emerges from a circle of holes in the end face of a steering air ring arranged on the front end of the atomizer housing. The number, diameter, shape and direction of the holes may be chosen differently in order to optimize the air speed, the air quantity and the width of the spray jet. The respective steering air quantity that defines the desired spraying width is predetermined in the form of a parameter of the coating process, and is controlled in a closed control loop.

Arrangements of outlet openings in the form of annular slits can be provided for the steering air, instead of holes. In the rotary atomizer known from EP 0092043, an outer annular slit is provided in addition to a radially inner annular slit, wherein this outer annular slit is supplied with compressed air by the same source as the inner annular slit. The width of one or both annular slits is adjustable. The outer air curtain produced by the additional annular slit has the function of compensating for the marginal turbulence produced by the coating substance cloud in interaction with the inner air current, and of returning escaped coating particles back into the cloud.

In other rotary atomizers, radially outer auxiliary outlet openings for air are provided in addition to the radially inner air openings, wherein the air emerging from the auxiliary outlet openings is intended to prevent the coating particles from returning into the atomizer.

One general problem in the utilization of atomizers is that atomizing cones of different widths are required for coating different workpiece regions. Known high-speed rotary atomizer systems, for example, for coating car bodies, are preferably designed in such a way that, when coating large areas, bell dishes with a larger diameter are used and the width of the spray jet (defined as SB 50%, i.e., as the width at 50% of the maximum layer thickness of the individual profile) is adjusted to a value of approximately 300–550 mm. Smaller bell dishes are used for detail coating and interior coating processes, as well as for coating attachments and other small components such as mirrors, decorative strips and shock absorbers, where the width of the spray jet is usually adjusted to a value between 180–300 mm. When using smaller or narrower spraying patterns, the application efficiency, which is defined as the ratio between the coating material that is sprayed and the coating material that is precipitated, is higher than when using wider spraying patterns. This makes it possible to significantly reduce the costs, as well as the consumption of coating material.

EP 1114677 discloses an atomizer with exchangeable bells that differ from one another with respect to their diameter, spraying direction, and steering air quantity. The appropriate bell is chosen as a function of the shape of the object to be coated and the color used, etc. For example, a bell with a large diameter is used for exterior surfaces, and a bell with a smaller diameter is used for interior surfaces of car bodies.

If the coating process cannot be interrupted in order to replace the spraying head, high efficiency and a uniform coating layer can be achieved only by comprehensive coating of a workpiece with wide and narrow spray jet adjustments. Since it is not possible to adjust the spray jet to a sufficiently small size, it is necessary to make compromises with respect to the efficiency, the consumption of coating material, and the color shade, between the bell dish size with the corresponding steering air supply, and the jet width. Although superior constriction of the spray jet can be achieved by reducing the rotational speed, this results in a reduced atomizing fineness and deterioration of the coating quality. Until now, it has not been possible to optimally adjust the spray jet to both of the above-mentioned widths with the steering air of a given atomizer. This resulted in significant disadvantages in practical applications, for example, insufficient or impossible interior or detail coating processes, increased overspray (the portion of coating material sprayed past the object), low application efficiency, increased consumption of coating material, and insufficient coating quality.

SUMMARY OF INVENTION

The invention is based on the objective of eliminating these disadvantages and of disclosing a method and an atomizer which respectively make it possible to adjust the width of the spray jet within a significantly broader range than has thus far been possible, namely without having to replace the spraying head or mechanically change the outlet opening arrangement, and while still ensuring an optimal coating process with superior application efficiency and coating quality.

This objective is attained with the characteristics disclosed in the claims.

The at least two steering air currents (or other gas currents used for the same purpose) that are controlled in a closed control loop are normally not generated simultaneously, but rather are used selectively depending on the workpieces or workpiece regions to be coated. However, it would also be conceivable to simultaneously utilize steering air currents that can be controlled independently of one another.

The invention makes it possible to carry out comprehensive coating processes including interior, exterior and detail coating processes on complex workpiece geometries and, in particular, entire car bodies with one and the same rotary atomizer. In this case, the application efficiency is maximized because the spray jet width can be precisely adjusted within the entire required range. The utilization of two steering air currents that can be controlled independently of one another makes it possible to adapt the width of the spray jet to each object to be coated in an optimal fashion.

This optimally adjusted spray jet results in less overspray, such that the application efficiency is improved and the consumption of coating material is reduced. This optimization simultaneously improves the coating quality.

BRIEF DESCRIPTION OF THE DRAWINGS

Other advantages of the present invention will be readily appreciated as the same becomes better understood by reference to the following Detailed Description when considered in connection with the accompanying drawings.

DETAILED DESCRIPTION OF THE INVENTION

Figure 1:
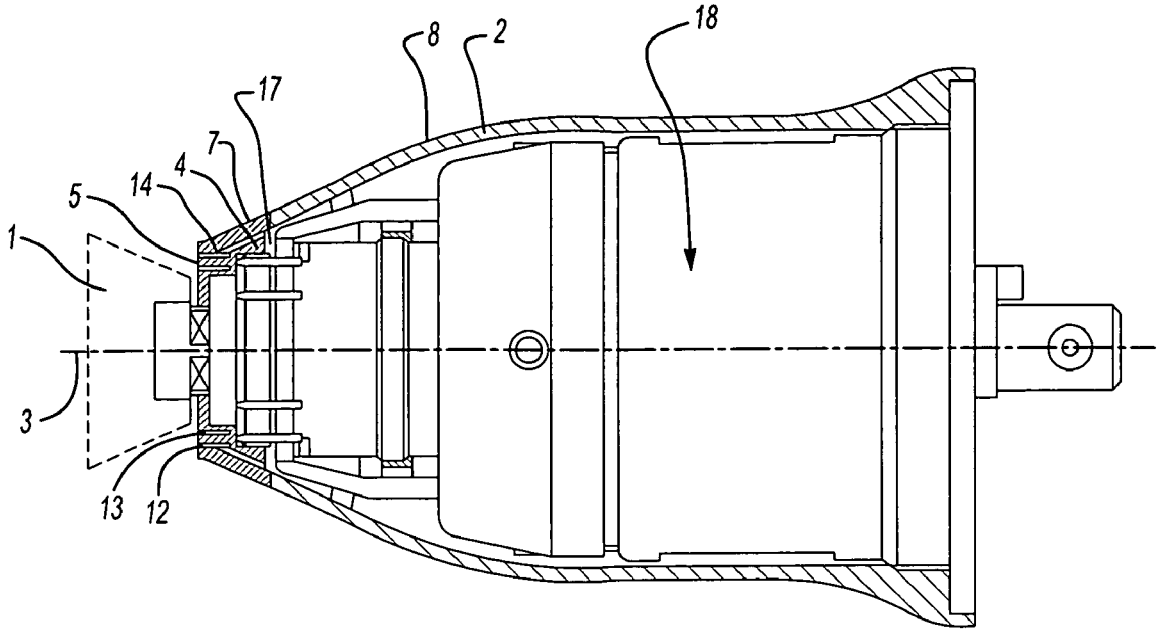
FIG. 1, a rotary atomizer with a steering air ring according to the invention.

With the exception of the described steering air control of the spray jet, the electrostatic rotary atomizer shown in FIG. 1 can correspond to the prior art, e.g., the above-mentioned DE 4306800. A steering air ring 4 is conventionally arranged coaxial to the atomizer axis 3 on the end face of the atomizer housing 2 that faces the bell dish 1. The holes 12, 13 for the steering air that serve to adjust the width of the spray jet and are described below end in the radially extending end face 5 of the steering air ring 4 that faces the bell dish 1 and consequently the atomizing cone formed by the sprayed coating material. The peripheral surface 7 of the annular body of the steering air ring 4 conically widens downward as shown in the figure, and is aligned flush with the adjacent peripheral surface 8 of the housing 2. Air turbulence around the atomizer is prevented due to the uninterrupted and smooth outer contour of the entire atomizer periphery, wherein undesired influence of the spraying process on the bell dish 1 as well as contamination of the atomizer housing are prevented.

The end face 5 of the steering air ring 4 can be situated axially behind the bell dish 1 as in the embodiment shown, wherein this end face can extend radially inward into the vicinity of the hollow shaft of the air turbine that drives the bell dish 1. The steering air ring 4 could also be completely inserted into the open end face of the atomizer housing 2. In another embodiment, the steering air ring 4 with its arrangement of the outlet openings projects axially forward over the bell dish 1.

Figure 2A:
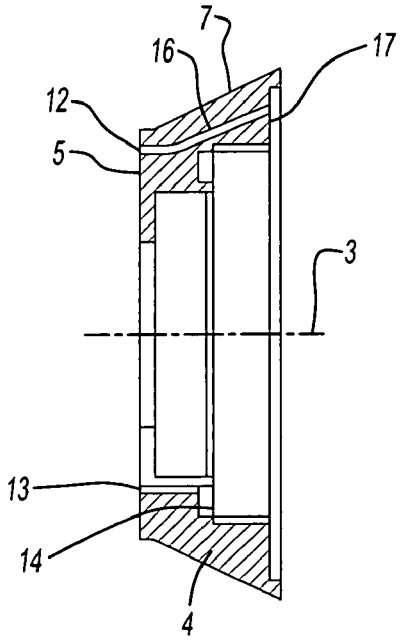
FIG. 2*a*, a section through the steering air ring of the atomizer.
Figure 2B:
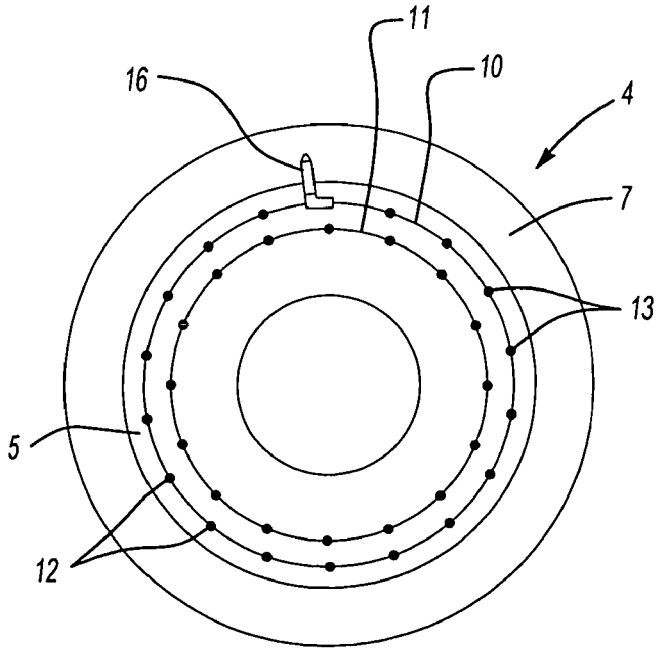
FIG. 2*b*, a top view of the steering air ring of FIG. 2*a* that is viewed from the left.

FIG. 2*a* and FIG. 2*b* show the steering air ring 4 in greater detail. Two rings of steering air holes 12 and 13 at equal distances apart forming concentric partial circles 10 and 11 with different diameters that are arranged concentric to the atomizer axis 3 (FIG. 1), and consequently also to the atomizing cone axis, terminate in end face 5.

In the embodiment shown, the holes 12 and 13 are respectively arranged in the end face 5 in an axially parallel fashion. However, it is possible to realize other arrangements. The radially inner holes 13 are supplied by an annular channel 14 within the steering air ring 4 which is connected to a (not-shown) compressed air line of the atomizer. The outer holes 12 of the steering air ring 4 first run axially from the end face 5 and then, as shown in the FIGURE, with rear part 16 run approximately parallel to the peripheral surface 7 radiating out to annular channel 17. The latter annular channel 17 is after installing the steering air ring 4, formed between the rear side of the steering air ring 4 and the adjacent parts of the atomizer, wherein this annular channel 17 is supplied by another compressed air line of the atomizer.

Instead of utilizing two circles of holes 12 and 13, it would also be conceivable to provide outlet opening arrangements in the form of annular slits in a steering air ring or, if applicable, in separate components of the atomizer.

The two aforementioned compressed air lines may, for example, each be connected to a compressed air connection of the atomizer for external lines, each of which can lead to its own air control system. For example, if the expenditure for two separate air controllers is unjustifiably high, the compressed air lines can also be connected to a common air control system for the holes 12 and 13 by means of a reversing valve that is controlled as a function of the respective workpiece region to be coated. The reversing valve does not necessarily have to be situated outside the atomizer, but can also be installed in the atomizer, for example, in the valve unit 18, such that only one external steering air connection is required. It would also be conceivable to control the steering air within the atomizer.

When coating workpieces, e.g., car bodies, the first controlled steering air emerging from the radially inner holes 13 is preferably used for adjusting wide spray jets (for example, SB 50% of 250–300 mm) for the exterior coating process. In this case, the second steering air, which is controlled separately from the first steering air and emerges from the holes 12 in the larger graduated circle 10, is used for adjusting narrower spray jets (for example, SB 50% of 50–300 mm) for detail and interior coating processes, wherein it may be practical for both regions to overlap (as in the described example). This means that the width of the spray jet can be adjusted within the entire range required for the exterior, interior and detail coating processes (50–550 mm in the described example) with one and the same atomizer, without having to interrupt the coating process and without having to accept significant disadvantages. The two steering air currents can be used and controlled independently of one another, i.e., one steering air can be switched off while the atomizer operates with the other steering air. The first steering air that emerges from the inner holes 13 behind the bell dish 1 impacts the conically downward tapered peripheral surface of the bell dish 1 relatively far toward the rear, wherein an air cushion is generated around the bell dish 1 and a uniform air distribution is advantageously achieved during atomization. The second steering air emerging from the outer holes 12 can, by contrast, be directed a slight radial distance (on the order, for instance, of 1 mm) outside the spraying edge of the bell dish 1 such that it impacts the coating material that needs to be or already is partially atomized by rotation. This causes a more intense constriction of the spray jet than that of the steering air emerging from the inner holes 13 such that the efficiency is maximized and small workpiece regions or workpiece regions that are difficult to access can also be adequately coated.

The invention has been described in an illustrative manner, and it is to be understood that the terminology which has been used is intended to be in the nature of words of description rather than limitation.

Obviously, many modifications and variations of the present invention are possible in light of the above teachings it is, therefore, to be understood that within the scope of the appended claims, wherein reference numerals are merely for convenience and not to be in any way limiting, the invention may be practiced otherwise than as specifically described.

What is claimed is:

1. An atomizer for the series coating of workpieces, comprising:

a bell dish having a generally conical outer surface and a longitudinal rotational axis; and a steering gas ring adjacent to and opposite said generally conical outer surface of said bell dish, including a first plurality of equally circumferentially spaced inner gas shaping holes defined around a first circle directing shaping gas against said generally conical outer surface of said bell dish during application of paint by said atomizer, and a second plurality of equally circumferentially spaced outer gas shaping holes defined around a second circle having a radius greater than said first circle during application of paint by said atomizer to generate a narrower paint spray pattern than a paint spray pattern generally by directing shaping gas through said first plurality of equally circumferentially spaced inner gas shaping holes.

2. The atomizer as defined in claim 1, wherein said first and second plurality of equally circumferentially spaced inner and outer gas shaping holes are coaxially aligned with said longitudinal rotational axis of said bell dish.

3. The atomizer as defined in claim 1, wherein said first plurality of equally circumferentially spaced inner gas shaping holes extend parallel to said longitudinal rotational axis of said bell dish.

4. The atomizer as defined in claim 1, wherein each of said first and second plurality of equally circumferentially spaced inner and outer gas shaping holes are independently connected to a source of gas under pressure to independently control the flow of gas through said first and second plurality of equally circumferentially spaced inner and outer gas shaping holes to independently achieve different paint spray patterns.

5. The atomizer as defined in claim 1, wherein said first and second plurality of equally circumferentially spaced inner and outer gas shaping holes are cylindrical.

6. The atomizer as defined in claim 1, wherein said second circle has a radius less than a radius of said generally conical outer surface of said bell dish directing shaping gas against said generally conical outer surface of said bell dish.

7. An atomizer for the series coating of workpieces, comprising:

a bell dish having a generally conical outer surface and a longitudinal rotational axis; and a steering gas shaping ring adjacent to and opposite said generally conical outer surface of said bell dish, including a first plurality of circumferentially spaced inner gas shaping holes defined around a first circle directing shaping gas against said generally conical outer surface of said bell dish during application of paint by said atomizer, and a second plurality of equally spaced outer gas shaping holes defined around a second circle having a radius greater than said first circle but less than a radius of said conical outer surface of said bell dish directing shaping gas against said conical outer surface of said bell dish at a radius greater than a radius of said first plurality of circumferentially spaced inner gas shaping holes during application of paint by said atomizer to generate a narrower paint spray pattern than a paint spray pattern generated by directing shaping gas through said first plurality of circumferentially spaced inner gas shaping holes and said first and second plurality of circumferentially spaced inner and outer gas shaping holes connected to a source of gas under pressure having a control permitting independent direction of shaping gas through either of said first and second circumferentially spaced inner and outer gas shaping boles.

8. The atomizer as defined in claim 7, wherein said first and second circumferentially spaced inner and outer gas shaping holes are equally circumferentially spaced.

9. The atomizer as defined in claim 7, wherein said first and second plurality of circumferentially spaced inner and outer gas shaping boles are coaxially aligned with said longitudinal rotational axis of said bell dish.

10. The atomizer as defined in claim 7, wherein said first and second plurality of circumferentially spaced inner and outer gas shaping holes are cylindrical.

11. A method of series coating of workpieces, comprising to following steps:

positioning a bell dish baying a generally conical outer surface and a longitudinal axis in a rotary atomizer;

locating a gas shaping ring opposite said generally conical outer surface of said bell dish including a plurality of circumferentially spaced inner gas shaping holes and a second plurality of circumferentially spaced outer gas shaping holes surrounding said first plurality of circumferentially spaced inner gas shaping holes;

directing paint under pressure against said bell dish to apply paint to a substrate and simultaneously directing shaping gas trough said first plurality of circumferentially spaced inner gas shaping holes to generate a first paint spray pattern; and directing paint under pressure against said bell dish and simultaneously directing shaping gas through said second plurality of circumferentially spaced outer gas shaping holes to generate a second paint spray pattern different from said first spray pattern.

12. The method as defined in claim 11, wherein said method includes directing shaping gas through said second plurality of circumferentially spaced outer gas shaping holes to generate a narrower paint spray pattern than a paint spray pattern generated by directing shaping gas through said first plurality of circumferentially spaced inner gas shaping holes.

13. The method as defined in claim 11, wherein said method includes directing shaping gas under pressure through only said first plurality of circumferentially spaced inner gas shaping holes, then discontinuing directing gas through said first plurality of circumferentially spaced inner gas shaping holes and then directing shaping gas through said second plurality of circumferentially spaced outer gas shaping holes to generate a different paint spray pattern.

* * * * *

UNITED STATES PATENT AND TRADEMARK OFFICE

CERTIFICATE OF CORRECTION

PATENT NO. : 6,991,178 B2
APPLICATION NO. : 10/713910
DATED : January 31, 2006
INVENTOR(S) : Hans-Jürgen Nolte et al.

It is certified that error appears in the above-identified patent and that said Letters Patent is hereby corrected as shown below:

On the title page item (75), insert the following:

--Thomas Duerr, Roland Felka, Rainer Laufer and Siegfried Lütke-- after "Peter Marquardt."

Column 6, line 11, please delete "boles" and insert --holes--.

Column 6, line 17, please delete "boles" and insert --holes--.

Column 6, line 23, please delete "to" and insert --the--.

Column 6, line 24, please delete "baying" and insert --having--.

Column 6, line 35, please delete "trough" and insert --through--.

Signed and Sealed this

First Day of August, 2006

JON W. DUDAS
*Director of the United States Patent and Trademark Office*